United States Patent [19]

Zmoda

[11] 3,939,090

[45] Feb. 17, 1976

[54] ANTIFOGGING CLEANER

[75] Inventor: Barney J. Zmoda, Bridgewater Township, N.J.

[73] Assignee: Colgate-Palmolive Company, New York, N.Y.

[22] Filed: Oct. 23, 1973

[21] Appl. No.: 408,739

[52] U.S. Cl. ..... 252/90; 106/13; 134/40; 252/DIG. 10; 252/171

[51] Int. Cl.[2] ..... C11D 7/50

[58] Field of Search..... 252/90, DIG. 10, DIG. 2, 252/156; 106/13; 134/2, 40

[56] References Cited

UNITED STATES PATENTS

| | | | |
|---|---|---|---|
| 3,679,592 | 7/1972 | Schomburg | 252/DIG. 10 |
| 3,696,043 | 10/1972 | Labarge et al. | 252/DIG. 10 |
| 3,819,522 | 6/1974 | Zinoda et al. | 252/DIG. 10 |

*Primary Examiner*—William E. Schulz
*Attorney, Agent, or Firm*—Steven J. Baron; Norman Blumenkopf; Herbert S. Sylvester

[57] ABSTRACT

There is disclosed a composition comprising approximately by weight (a) 0.01 to 0.1% of a copolymer of (1) an ethylenically unsaturated polymeric anhydride or partial ester and (2) an ethylenically unsaturated monomer; (b) up to 10% of at least one lower alkylene glycol lower alkyl monoether, (c) up to 25% of an aliphatic alcohol; (d) 0.1 to 2% of an ethoxylated $C_{10-18}$ alkali metal sulfate and the balance water. Components (b) and (c) may both be present, or a greater amount of one to compensate for the absence of the other.

11 Claims, No Drawings

ANTIFOGGING CLEANER

This invention relates to compositions of matter which are particularly suitable for use in cleaning glass or glass-like surfaces and to an anti-fogging agent. The invention relates more particularly to a novel aqueous solution comprising a water soluble carboxyl containing copolymer, preferably at least one glycol mono ether and an alkoxylated alcohol alkali metal or ammonium sulfate, and if desired, a hydroxide. The invention contemplates both a concentrate or an aqueous composition. The composition may be applied in any customary manner in addition to being dispensed from a spray bottle or aerosol container.

A good glass cleaner should have excellent soil and grease removability, good hard surface detergency, that is, have the ability to remove encrusted dirt deposits and the like, be non-streaking, fast-drying, impart anti-fogging characteristics to the thus cleaned glass and be easily dispensable for convenience of use. If aerosol application is desired, the composition should in addition to the above-noted characteristics be able to create a foam or foam-like mixture which breaks easily, yet does not run; thereby remaining in situ until removed, such as by being rubbed off or washed off.

There are presently a number of glass cleaning compositions available, some of which meet one or more of the above specifications, however, it is not believed that any one composition is able to meet all of the above specifications. In addition to the cleaning and non-streaking problems associated with glass cleaners, a more important problem generally is the fogging of the glass which occurs subsequent to use of the cleaning composition. The formation of fog on glass surfaces resulting in loss of visibility is a problem which has troubled homeowners, drivers, pilots, wearers of eyeglasses and virtually anyone who depends upon clear visibility through a glass such as a window, glass door, display showcase, and an eyeglass. The attention which has been paid to this problem is evidenced by industry's endeavor to produce an anti-fogging or de-fogging glass cleaning composition.

Glass fogging is caused at least in part by the condensation of steam or water vapor when the surface temperature of the glass is below the dew point. The condensation of moisture droplets onto the glass surface causes the formation of an opaque fog, slightly translucent at best, the foregoing rendering the glass surface difficult to see through and thereby causing an obstruction to clear vision. It is known to utilize various surface active agents to reduce the surface tension and thereby enhance the coalescence of individual water droplets thereon into a larger, more translucent form. These prior art compositions, however, while possessing adequate de-fogging characteristics, possess a series of other undesirable properties, such as high initial film formation, image distortion, streaking, smearing and smudging on the surface. From the foregoing, it is readily apparent that a preferred glass cleaning composition and anti-fogger should possess superior properties in each of the above categories as well as possessing adequate if not better than adequate antifogging ability.

It is accordingly an object of this invention to provide a novel and improved glass cleaning and anti-fogging composition.

It is another object of the instant invention to avoid one or more drawbacks of the prior art.

For handling purposes and for ease of preparation and marketing, the composition may be prepared as a concentrate. A typical concentrated solution will be generally a 4 to 25% non-aqueous solution to which there would thereafter be added water to form the aqueous composition. The composition may be dispersed from a spray container or from an aerosol container if desired. The composition is made by mixing the ingredients in any order, preferably, however, the polymer is first dispersed in a solvent.

Broadly speaking, the instant invention includes the provisions of an aqueous composition comprising approximately by weight a. 0.01 to 0.1% of a copolymer of
   1. a monomer derived from an ethylenically unsaturated carboxylic acid anhydride or partial ester with
   2. a non-carboxylic containing ethylenically unsaturated monomer,
b. up to 10% of at least one lower alkylene glycol lower alkyl monoether,
c. up to 25% of an aliphatic alcohol,
d. 0.1 to 2% of an alkoxylated $C_{8-20}$ alkali metal or ammonium sulfate, and the balance water.

Component (b) may be replaced by increasing the amount of component (c) or vice versa.

The invention, as aforesaid, also contemplates a liquid concentrate comprised of approximately the following: (a) 0.01 to 1.0 part, preferably 0.01 to 0.06 parts of the copolymer, (b) 0 to 10 parts, preferably 2 to 6 parts of at least one of said glycol monoether; (c) 0 to 10 parts, preferably 2 to 6 parts of the aliphatic alcohol; (d) 0.01 to 3.0 parts, preferably 0.1 to 0.9 parts of the alkoxylated alcohol alkali metal or ammonium sulfate; and (e) 0 to 2 parts, preferably 0.1 to 0.8 parts of a base; the above concentrated solution may be diluted with water for ready application in a proportion of about 1 part concentrate to about 9 parts water.

A most preferred composition embodying the above concentrate will be as follows:

| | Parts | | Percent of Concentrate | |
|---|---|---|---|---|
| a) Copolymer | 0.04 | | 0.44 | |
| b) Glycol monoether | 2.00 | 4.5 | 21.9 | 49.3 |
| glycol monoether | 2.50 | | 27.4 | |
| c) Aliphatic alcohol | 3.80 | | 41.6 | |
| d) Alkoxylate sulfate | 0.50 | | 5.5 | |
| e) Base | 0.30 | | 3.3 | |
| | 9.14 | parts | 100.14 | |

For the purposes of this invention, any water soluble alkali metal salt or ammonium salt of any $C_{8-20}$ alkoxylated alcohol sulfate may be employed. The alkylated alcohol sulfates have the general formula $R—O—(R^1O)_x—SO_3M$ wherein R is a straight or branched chain alkyl group having from 8 to 20 carbon atoms, preferably 10–18, $R^1$ is an alkyl radical containing from 2 to 4 carbon atoms, preferably 2, $x$ is an integer of 2–200, preferably 2–20, optimally 2–3, and M is an alkali metal such as sodium, potassium and the like, preferably sodium. Although any of the higher fatty acid alkoxylated sulfates may be utilized, it is preferred to utilize a sulfate wherein R is a fatty alkyl from between 10 to 18 carbons, optimally 12–15 carbons. The alkoxylation reaction is carried out by procedures known in the art and accordingly, need not be discussed herein. An example of alkylene oxide condensation product as above referred to, with an active hydrocarbon-containing hydrophobe may be prepared from an alkylene oxide or a precursor thereof and a hydrophobe containing an active hydrogen. The alkylene oxides include precursors as well, having from 2 to 4 carbon atoms, such as ethylene oxide, propylene oxide, and the like; ethylene oxide being preferred. Mixtures of such alkylating agents may also be used. The degree of alkoxylation will optimally be such that about 3 moles of ethylene oxide are employed. However, the effective amount of ethylene oxide can vary between about 2–200 moles as aforesaid and may be readily determined in any particular case by preliminary tests and routine experimentation.

The amount of alkoxylated alcohol alkali metal or ammonium salt employed will generally be about 0.1 to 2%, preferably about 0.5 to 0.9%, optimally about 0.5 to 0.7%.

These alkali metal salts of alkoxylated alcohol sulfates (anionic detergents) generally have the fatty alkyl group terminally joined to the polyoxyethylene chain which is of necessity terminally joined to the sulfur of the sulfate group. Although a degree of a branching of the higher alkyl group is satisfactory, such as for example with secondary alcohols, the alcohols employed will generally be straight chained due to availability considerations. Furthermore, medial joinder of the alkyl to the ethanoxy chain should be minimized although a small percentage up to about 10% of medial joinder near one end of the alkyl chain is acceptable. As noted above, the preferred range of the alkyl is from 10 to 18 carbon atoms and within this range, the mixed alkyls having 12 to 15 carbon atoms are most preferred, these mixtures containing approximately between 10 and 50% of each chain length.

Examples of the higher alcohol polyethenoxy sulfates which may be used as the anionic sulfate in the present invention include: mixed $C_{12-15}$ normal primary alkyl triethenoxy sulfate; ammonium salt; myristyl triethenoxy sulfate, potassium salt; n-decyl diethenoxy sulfate, sodium salt, lauryl diethenoxy sulfate, ammonium salt, palmityl tetraethenoxy sulfate, sodium salt; mixed $C_{12-15}$ normal primary alkyl mixed tri- and tetraethenoxy sulfate, sodium salt; stearyl pentaethenoxy sulfate, ammonium salt and mixed $C_{10-18}$ normal primary alkyl triethenoxy sulfate, potassium salt.

The carboxyl containing copolymer may be any suitable member which is water soluble and a mild film former operative to harden the window cleaner residue left on the glass at the time of application. The copolymer may be employed as an anhydride which upon hydrolysis yields a highly polar polymeric free and/or partial ester. The polymeric anhydrides which are herein contemplated are interpolymers of at least one ethylenically unsaturated monomer with an anhydride linkage. The preferred anhydrides are the alpha-beta-unsaturated dicarboxylic acid anhydrides and particularly those of the maleic anhydride series having the formula:

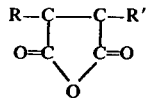

wherein R and $R^1$ are independently selected from the group consisting of hydrogen, alkyl, aryl, aralkyl, substituted alkyl, aryl or aralkyl. Examples of such compounds are: maleic anhydride, citraconic anhydride (methyl maleic), fumaric anhydride, mosaconic anhydride, phenyl maleic anhydride, benzyl maleic anhydride and aconitic anhydride. Particularly preferred is maleic anhydride having the formula:

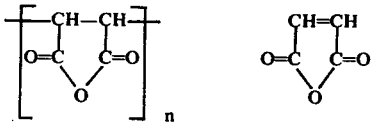

wherein *n* indicates the number of repeating units, it is generally from 2 to about 100 or more.

The polymerizable non-carboxylic comonomers containing an ethylenic group which may be employed with the above-described anhydrides include those well known ethylenically unsaturated compounds copolymerizable therewith such as:

Vinyl ethers, such as lower alkyl vinyl ethers, i.e., methyl, ethyl, n-propyl iso-propyl, n-butyl and iso-butyl ethers; monoalkenyl aromatics, such as styrene, alpha-methylstyrene, and other lower alkyl substituted styrenes; olefins such as the lower olefins, e.g., ethylene, propylene, isobutylene and the like.

The copolymers preferably contain the two moieties in equamolar amounts whereby the repeating unit in the interpolymer contains one anhydride and one comonomer moiety.

Examples of specific copolymers which may be employed are: vinyl methyl ether/maleic anhydride, vinyl ethyl ether/maleic anhydride, styrene/maleic anhydride, alpha,methyl-styrene/maleic anhydride and ethylene/maleic anhydride.

When the copolymer dissolves in water or in alcohol, the anhydride linkage is cleaved as follows:

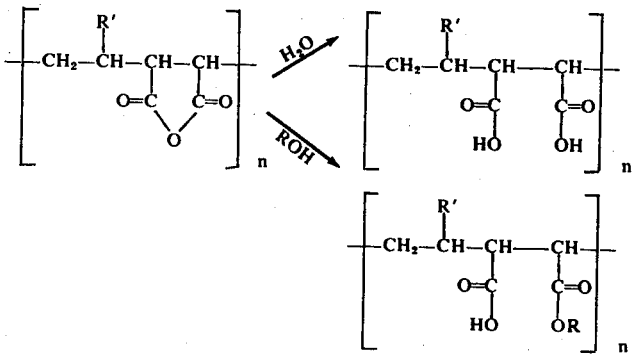

wherein $n$ and $R^1$ are as above defined; $R^1$ being derived from the ethylenically unsaturated copolymerizable monomer. The anhydride slowly hydrolyzes to form the free acid which is readily water soluble.

The copolymers above described may vary in molecular weights from as low as about 400 to several million (e.g., 2 million) or more. The copolymers as such, are known in the art and may be prepared by any conventionally known procedure. It is noteworthy that the degree of polymerization of the copolymer influences its molecular weight and inasmuch as the polymers employed herein must be water soluble, this factor must be taken into consideration. It is difficult, however, to establish an absolute value of the upper and lower limits of the degree of polymerization of the polymers, which limits may vary within a wide range. It is essential as aforesaid, that they be substantially water soluble and, therefore, the foregoing determines the degree of polymerization. Preferred copolymers are those having a low molecular weight. The copolymer will be employed in amounts as specified above. The percent solids copolymer in the composition is generally about 0.01 to 0.1, preferably 0.03 to 0.05.

Preferably, the copolymers are added to an aqueous solution containing the other essential ingredients except for any nonionics or base, as rapidly as possible with stirring and heating. The foregoing applies when the copolymers are not employed in their pre-hydrolized form. Hydrolyzed copolymer can be dispersed directly in the alcohol or the glycol ethers, or the combination then added to the water phase. For best results, it has been observed that alkali materials and nonionics should not be present during the hydrolysis of the copolymer. It has also been found that if the copolymers are not rapidly dispersed in the aqueous mixture, the viscosity of the resultant product may be too low from the standpoint of preparing a commercially acceptable product. In general, the stability is less at the lower viscosity. The copolymer may be added gradually to the aqueous mixture or all at once. However, each addition should be rapidly admixed with the aqueous phase.

Among the surface-active materials present as a component in the instant invention, members derived from the following may be employed: lower alkylene glycol lower alkyl monoethers. Particularly suitable are the ethylene and propylene glycol ethers derived from straight chain primary alcohols containing 1 to 6 carbon atoms. Particularly preferred are the ethers of monohydric alcohols having the formula $R—OR^2—OH$ wherein R is an aliphatic radical selected from the group consisting of methyl, ethyl, propylene, butyl and isobutyl radicals and $R^2$ is an aliphatic radical selected from the group consisting of ethanol, propanol and isopropanol radicals. Examples of the above are ethylene glycol monomethyl ether, ethylene glycol monoethyl ether, ethylene glycol monobutyl ether, propylene glycol monomethyl ether, propylene glycol monobutyl ether and the like. The above monoether glycols are believed to function as a solvent for the dirt and the like upon the glass surface to be cleaned. Glycol ethers and alcohol also serve to promote rapid drying of the above surface. They may be employed singly or in admixture. Generally, there will be present at least one in amounts as specified above.

The alcoholic components of the invention comprise any lower aliphatic alcohol having from 1 to 6 carbon atoms, such as the monohydric alkanols, i.e., methyl, ethyl, propyl, isopropyl, butyl, isobutyl, secbutyl and the like. The function of the alcohol is also believed to be that of a solvent. The alcohol also adds the additional function in that it imparts freeze-thaw stability to the composition.

The alcoholic component may be employed in amounts as specified above.

The base component or hydroxide acts as a detergent and also functions as a cleaning agent. A suitable base component is sodium, potassium or ammonium hydroxide. Other hydroxides can be utilized as substitutes, though ammonium hydroxide is preferred. The base is generally employed in amounts as specified above. A most preferred component is 26°Be ammonia, 29% active.

The balance of the composition in order to bring same up to 100% will generally be water.

In the aerosol embodiment of the invention a propellant must be used. It is preferred that the propellant be volatile organic material that exists as a gas at room temperature, exists mainly as a liquid at room temperature and elevated pressure and is soluble in either the glycol ether or in water but not in both. Saturated aliphatic hydrocarbons and halogenated (e.g., fluorinated) saturated aliphatic hydrocarbons having vapor pressures within the range of about 5 to 300 p.s.i.g., preferably about 10 to 85 p.s.i.g. at 70°F are typical of the propellants which may be used in this invention. The chlorofluoro saturated aliphatic hydrocarbons such as dichlorodifluoromethane, monochlorodifluoromethane, dichlorotetrafluoroethane, dichlorodifluoroethane, difluoroethane, dimonochloroethane and mixtures thereof have been found to be particularly suitable propellants. It is preferred that the above propellant be a 35–65 part mixture of dichlorodifluoromethane and dichlorotetrafluoroethane (Freon 12 and 114, respectively). The amount of propellant employed varies depending upon the density of the propellant. Thus, the propellant should be added in such amount as to constitute about 2 to 30% and preferably about 3 to 17%, more preferably 8 to 15% and in certain instances, 10% by volume of the liquid composition. In the case of saturated aliphatic hydrocarbons of lower density such as butane, isobutane, n-butane, isopentane and n-pentane and mixtures thereof, an amount ranging from 1 to 10%, preferably 1–3%, by weight should be employed. It is to be understood that either group of propellants may be employed with equal success.

When the composition of the invention is dispersed from an aerosol container, an initial pressure in the range of about 10 to 85 p.s.i.g. at 70°F is generally created. In the case of glass and other fragile containers, such pressure should be kept in the range of about 10 to 30 p.s.i.g.

If a metallic aerosol container is employed, it is sometimes preferable to add a small proportion of a suitable corrosion inhibitor to the composition, for example, about 0.01 to 5% by weight of the composition. Typical inhibitors include sodium, oleic acid, N-fatty $\alpha$-mono propionate, N-fatty $\alpha$-amino dipropanol, hexanol, morpholine, formaldehyde and the like.

In operation, the composition is introduced into the aerosol container and confined therein at the vapor pressure of the propellant. When the valve of the container is opened, the pressure of the composition is released as it emerges from the container.

It is to be understood that the composition works equally as well on materials such as polysultone, "Plexiglas," (acrylics) "Lexane" and the like.

The following examples merely serve to illustrate the invention in more specific detail, and when read in conjunction with the foregoing description, will aid in determining the full scope of the present invention. The examples are merely illustrative and not intended to restrict the invention. All parts, proportions and ratios in the following examples as well as in the appended claims are by weight unless otherwise indicated.

EXAMPLE 1

A glass cleaning composition is formulated by mixing the following ingredients in the water component thereof.

| | |
|---|---|
| Water | 90.86 |
| Ethylene glycol monobutyl ether | 2.00 |
| Propylene glycol monomethyl ether | 2.50 |
| Isopropyl alcohol | 3.80 |
| $C_{12-15}$ sodium sulfate + 3EO | 0.50 |
| Methyl vinyl ether/maleic anhydride copolymer | 0.04 |
| Ammonium hydroxide | 0.30 |
| | 100.00% |

Coloring ingredients, perfumes and the like may be added if desired. The pH can also be adjusted if desired. The above composition, when used as a glass cleaner, particularly on windows, exhibits substantially no streaking and imparts antifog properties to the thus treated glass.

EXAMPLES 2–4

The procedure of Example 1 is followed with the substitution of the following copolymers: ethyl vinyl ether/maleic anhydride, styrene/maleic anhydride, and ethylene maleic anhydride. The same good results are obtained.

EXAMPLES 5–6

The procedure of Example 1 is repeated except that the ether component is varied as indicated: ethylene glycol monomethyl ether and propylene glycol monobutyl ether. The same good results are obtained.

EXAMPLES 7–8

The procedure of Example 1 is repeated except that the alcohol component is varied as follows: butyl alcohol and ethyl alcohol are substituted. The same good results are obtained.

EXAMPLE 9

The procedure of Example 1 is repeated except that a $C_{12-15}$ potassium sulfate + 3EO is substituted.

EXAMPLE 10

When a formulation is desired for aerosol application, 98.2% of the formulation of Example 1 is admixed with 1.8% propellant comprising 87 parts isobutane and 13 parts propane packaged in an aerosol container with a valve to a pressure of 58–64 p.s.i.g. When the mixture is sprayed upon a glass surface, the same good results are obtained.

The foregoing description of the invention has been presented describing certain preferable embodiments. It is not intended that the invention should be so limited since as is apparent from the preceeding description, certain changes and modifications thereof may be made and will be obvious to those skilled in the art when departing from the scope of the invention, all of which are within the subject and scope thereof.

I claim:

1. A composition consisting essentially of approximately by weight, (a) 0.01 to 1.% of a copolymer derived from (1) an $\alpha, \beta$ - ethylenically unsaturated dicarboxylic acid anhydride having the general formula

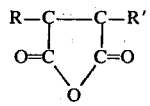

wherein R and R′ are independently selected from the group consisting of hydrogen, alkyl, aryl, aralkyl, substituted alkyl, aryl and aralkyl and (2) an ethylenically unsaturated monomer selected from the group consisting of vinyl ethers, styrene, alpha-methyl styrene, lower alkyl substituted styrenes and lower olefins, up to 10% of at least one lower alkylene glycol; lower alkyl monoether, (c) up to 25% of a $C_1$-6 aliphatic alcohol, (d) 0.1 to 2.0% of an ethoxylated $C_{10}$-18 alkali metal or ammonium sulfate having about 2–200 units of ethylene oxide and the balance water, with the proviso that at least one of component (b) or (c) is present.

2. A composition as defined in claim 1 wherein unit (1) of component (a) is maleic anhydride.

3. A composition as defined in claim 1 wherein component (b) is selected from the group consisting of ethylene glycolmonomethyl ether, ethylene glycolmonoethyl ether, ethylene glycolmonobutyl ether, propylene glycolmonomethyl ether, and propylene glycolmonobutyl ether.

4. A composition as defined in claim 3 wherein component (b) is a mixture of said monoethers.

5. A composition as defined in claim 1 wherein component (c) is a $C_1$-6 monohydric alkanol.

6. A composition as defined in claim 1 wherein component (d) is a $C_{12-15}$ sodium sulfate + 2–20 E.O.

7. A stable concentrate consisting essentially of approximately (a) 0.01 to 10 parts of a copolymer derived from (1) an $\alpha$, $\beta$ — ethylenically unsaturated dicarboxylic acid anhydride having the general formula

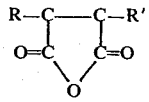

wherein R and R′ are independently selected from the group consisting of hydrogen, alkyl, aralkyl, substituted alkyl, aryl and aralkyl and (2) an ethylenically unsaturated monomer selected from the group consisting of vinyl ethers, styrene, alpha-methyl styrene, lower alkyl substituted styrenes and lower olefins, (b) 0–10 parts of at least one lower alkylene glycol lower alkyl monoether, (c) 0–10 parts of a $C_1$-6 aliphatic alcohol and (d) 0.1 to 0.9 parts of an ethoxylated $C_{10-18}$ alkali metal or ammonium sulfate having about 2–200 units of ethylene oxide.

8. An aerosol container packaged composition comprising approximately by weight the components of claim 1 in the following amounts: 0.01 to 0.1 of component (a), 0 to 10% of component (b), 0 to 25% of component (c), 0.1 to 2% of component (d) 0 to 98% water and 1 to 30% of an aerosol propellant.

9. An aerosol container packaged composition as defined in claim 8 wherein said propellant is selected from the group consisting of saturated aliphatic hydrocarbons and halogenated saturated aliphatic hydrocarbons.

10. An aerosol container packaged composition as defined in claim 8 wherein said propellant is a fluorocarbon.

11. A method of cleaning and defogging glass surfaces comprising applying thereto an effective amount of the composition as defined in claim 1.

* * * * *